US005265881A

United States Patent [19]

Doherty

[11] Patent Number: 5,265,881

[45] Date of Patent: Nov. 30, 1993

[54] METHOD OF PLAYING A DICE OR CARD GAME

[75] Inventor: Vincent Doherty, 1007 N. America Way, Ste. 305, Miami, Fla. 33132

[73] Assignee: Vincent Doherty, Miami, Fla.

[21] Appl. No.: 906,441

[22] Filed: Jun. 30, 1992

[51] Int. Cl.[5] ..... A63F 3/00

[52] U.S. Cl. ..... 273/274; 273/146; 273/292

[58] Field of Search ..... 273/274, 138 R, 292, 273/145 R, 146

[56] References Cited

U.S. PATENT DOCUMENTS

| | | | |
|---|---|---|---|
| 3,904,208 | 9/1975 | Grossman | 273/146 |
| 3,913,919 | 10/1975 | Carpenter | 273/146 |
| 3,998,462 | 12/1976 | Goott | 273/274 X |
| 4,247,114 | 1/1981 | Carroll | 273/274 |
| 4,312,508 | 1/1982 | Wood | 273/274 |
| 4,334,085 | 6/1982 | Robbins et al. | 273/274 |
| 4,346,900 | 8/1982 | Lamlee | 273/274 |
| 4,364,567 | 12/1982 | Goott | 273/274 X |
| 4,441,714 | 4/1984 | Goott | 273/274 X |
| 4,651,997 | 3/1987 | Wood | 273/274 |
| 4,659,087 | 4/1987 | Shen et al. | 273/274 |
| 4,887,819 | 12/1989 | Walker | 273/274 |
| 4,900,034 | 2/1990 | Bereuter | 273/274 |
| 4,902,019 | 2/1990 | Berman | 273/274 |

OTHER PUBLICATIONS

"Scarne's Encyclopedia of Games", Indian Dice (New York: Harper and Row Publishers, 1973, pp. 476–477.

Sears 1979 Christmas Book, 1979C, Yahtzee, p. 627.

"Scarne's Complete Guide to Gambling" by John Scarne (New York: Simon and Schuster), 1961 pp. 234–259.

*Primary Examiner*—V. Millin

*Assistant Examiner*—William M. Pierce

*Attorney, Agent, or Firm*—Herbert L. Lerner; Laurence A. Greenberg

[57] ABSTRACT

A new dice and card game is disclosed. The playing surface is arranged in two sections, each having betting boxes for the various combinations which can be rolled with the given number of dice or dealt with the given number of cards. The first section is used for wagering in a first round. If any of the players win in the first round, bets are placed on a step-up betting box and further wagers are placed on boxes in the second section. The second section is arranged such that certain betting boxes are associated with given betting boxes in the first section, i.e. the associated bets include the combinations of the first round.

8 Claims, 2 Drawing Sheets

METHOD OF PLAYING A DICE OR CARD GAME

BACKGROUND OF THE INVENTION

1. Field of the Invention

The invention relates to a dice and card game, more particularly to a dice game played on a specifically configured dice table and to a card game played on a similar table, as well as to a combination dice/card game.

2. Description of the Related Art

The instantly disclosed game could be best described as being similar in principle to a novel combination of the popular craps and poker games. Novel games are always coveted by gaming establishments and toy and game manufacturers. It has been known that games come into fashion and become obsolete, according to certain patterns. Only few games survive the test of time. A fine line appears to exist between games which are simple to learn, which is a requisite for a successfully popular game, and those that become uninterresting after only a short while.

SUMMARY OF THE INVENTION

It is accordingly an object of the invention to provide a novel dice game, which overcomes the hereinaforementioned disadvantages of the heretofore-known devices of this general type and which is relatively simple to learn, yet incorporates features from some of the most popular and proven games.

With the foregoing and other objects in view there is provided, in accordance with the invention, a method of playing a dice game with a given number of rolling dice, bet indicators and a playing surface divided in first and second sections and having betting boxes disposed thereon for placing the bet indicators; the method comprises placing a first wager in a betting box in the first section by at least one player;

rolling the dice to determine a first rolled combination;

if the first rolled combination is one of five-of-a-kind, straight or full house, the player with the corresponding wager is payed out and all of the dice are rolled again;

if the first wager does not correspond to the first rolled combination, starting a new game with the placing step;

if the first wager corresponds to the first rolled combination, paying the player appropriate odds;

placing a step-up wager in a betting box associated with the first wager betting box;

placing by at least one player a second wager in a betting box in the second section in a column of betting boxes associated with the first betting box;

temporarily storing the dice of the first rolled combination and rolling remaining dice of the given number of dice to determine a final rolled combination with the remaining dice and the first rolled combination; and if the final rolled combination corresponds to the second wager, paying the player predetermined winning odds.

In accordance with an added feature of the invention, the second wager in the second wager placing step is at least double the first wager in the first wager placing step.

In accordance with an additional feature of the invention, the step-up wager in the step-up wager placing step is at least as great as the first wager in the first wager placing step.

With the objects of the invention in view there is further provided, in accordance with a concomitant feature of the invention, in a dice and card game apparatus with rolling dice and/or cards having indicia on surfaces thereof and bet indicating means, a game surface comprising first and second sections, betting boxes disposed in each of the first and second sections, the betting boxes in the first section including one pair, two pair, triple, four-of-a-kind, five-of-a-kind, full house and straight boxes, step-up betting areas respectively associated with the one pair, two pair, triple and four-of-a-kind boxes in the first section, the second section including two pair, triple, four-of-a-kind, five-of-a-kind and full house boxes associated with the one pair box of the first section; a full house box associated with the two pair box in the first section; four-of-a- kind, five-of-a-kind and full house boxes associated with the triple box of the first section; and a five-of-a-kind box associated with the four-of-a-kind box of the first section; each of the boxes in the first and second sections having a general field for betting on a respective combination regardless of specifically rolled dice indicia or exposed card indicia and six fields each associated with one of the indicia on the dice and/or cards for betting on a respective combination of given indicia.

Other features which are considered as characteristic for the invention are set forth in the appended claims.

Although the invention is illustrated and described herein as embodied in a dice and card game, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
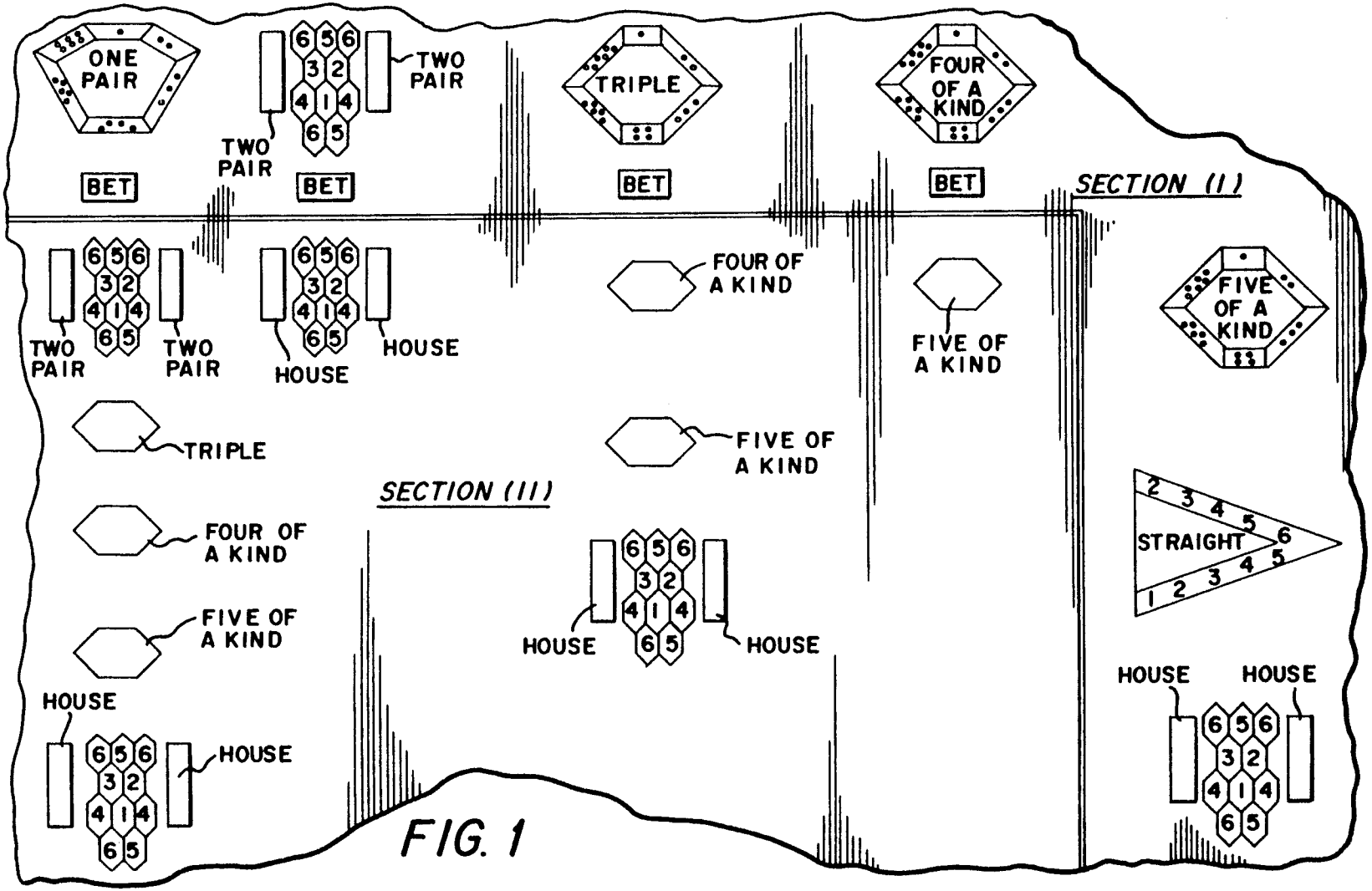
FIG. 1 is a top-plan view of a dice and card game surface according to the invention.
Figure 2:
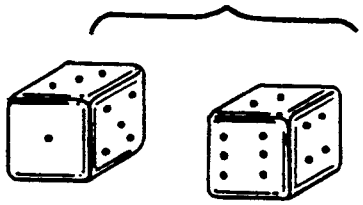
FIG. 2 is a perspective view of prior art rolling dice.
Figure 3:
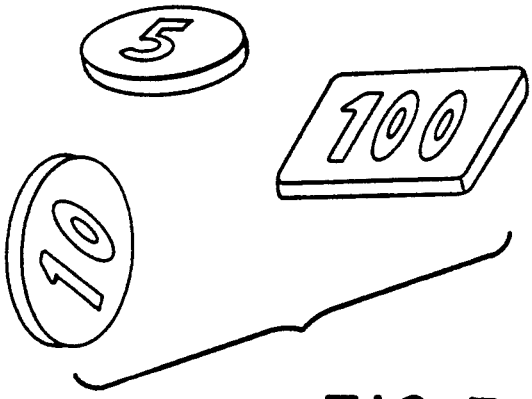
FIG. 3 is a perspective view of prior art bet indicators.
Figure 4:
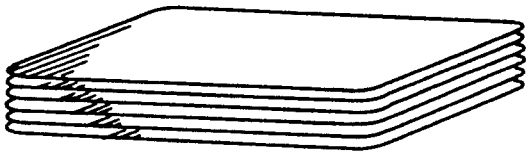
FIG. 4 is a perspective view of a prior art deck of cards.

Referring now to the drawings in detail and, first, particularly to FIG. 1 thereof, there is seen a surface on a dice and card game table which is basically divided into a first section (i) and a second section (ii).

The first (i) and second (ii) sections are representative of two betting levels, as will become apparent from the following examples.

Each of the first (i) and second (ii) sections has betting boxes or fields, which include one pair, two pairs, triple, four-of-a-kind, five-of-a-kind, straight and full house or, simply, house. The wagers five-of-a-kind, straight and house of the first section cannot be improved upon in a five-dice roll and these bets will be paid out immediately, according to established odds.

Each of the one pair, two pair, triple and four-of-a-kind fields of the first section (i) have a column of further bets associated therewith. For example, one pair appears in each of the bets shown in the left-hand column, i.e. two equal dice or cards form a part of the two pair, triple, four-of-a-kind, five-of-a-kind and house bets. The second column, associated with the two pair bet, has only one further bet, namely house. No other combination of five dice or cards which incorporates two pairs is possible. The third column from the left, associated with the triple box of the first section (i), includes four-of-a-kind, five-of-a-kind and house betting boxes. A three dice or card combination is included in each of these bets. The fourth column, associated with the four-of-a-kind bet of the first section (i), features a five-of-a-kind betting field as the only further bet at the second level.

The individual betting fields in the first section (i) are arranged such that it is possible to either bet the general occurrence of a particular combination or one may call for a particular combination to appear with specific numbers or dice indicia. For example, a player may place his bet indicator in the center of the one pair box and thus wager on, say, 1:1 odds, or he may alternatively place his bet indicator on one of the fields surrounding the center of the one pair box. The surrounding fields have indicia which are representative of the indicia on the rolling dice or on the cards; in the drawing, these indicia are between one and six dots. The odds for these specific number bets are accordingly higher.

These specific betting box configurations are not necessary in the betting boxes triple, four- and five-of-a-kind in the second section (ii), since the number indicia of the second betting level are already established in the first level. In other words, if a triple three was thrown on the first level, then the four- and five-of-a-kind are only possible in threes.

The two pair and house betting boxes are configured such that a given combination of numbers may be bet on by way of placing the bet indicator in a given location. For example, if the bet indicator is placed on the house betting box on the line between 3 and 6, the player bets on a full house with 3's over 6's. By placing the bet indicator on the line between, say, 3 and 4 on the two pair betting field, the player wagers on the occurrence of a pair of 3's and a pair of 4's.

One step-up wager area or second-stage betting field each is associated with the respective columns. The use of the step-up wager area will become clear from a description of the game. The following example is representative of the dice game according to the invention.

In the instant example, two players approach the table. They buy cash chips worth $5.00, which can be played at all other tables. One player places the $5.00 on the "one pair" box. The other player places $5.00 on the "triple" box, on the field with the four spots, i.e. he is backing three 4's to be rolled. The dice are handed to the first player, who throws all five dice across the table. The instant game is played on a small craps table, so that the dice are caught by a back wall. The craps table will not be described in detail since it is well known in the art and it is described, for instance, in my copending application Ser. No. 807,166.

One pair of 2's has been rolled. The bet on the triple box loses and is removed. The bet on the one pair box wins even money. The odds, of course, are set by the respective gaming establishment according to odds statistics which are well within the skill of the artisan. Combinations other than the pair will be paid higher odds.

Now the first player's original $5.00 chip is placed on the bet box immediately in front of the one pair box. $5.00 are paid to him as his winnings and he takes it off the layout.

The dice showing the two 2's are visibly placed in a glass container. The other three dice are handed to the player. Now, he must make a bet in the second section (ii). The bet, as set by the gaming establishment, must be twice as much as his bet in the first section (i), i.e. he is required to place at least $10.00 on any of the combinations in the column associated with the one pair box. In the instant case the first player places his $10.00 bet on the four-of-a-kind box.

The second player wants to make a bet as well. He must place $5.00 on the step-up box in the column associated with the one pair box and he places $10.00 in the triple box in the second section (ii), i.e. he hopes that one more 2 will be thrown.

Now the player picks up the three dice and throws them across the table. Two 2's come up again. All together there are now four 2's.

The bet on the triple box in the second section (ii) loses as well as the $5.00 bet in the step-up box. The respective bet indicators are removed from the playing surface. The first player, who bet on four 2's, is paid appropriate odds and he is also paid 1:1 on his $5.00 bet in the step-up box. Once all payouts have been made, a new game is started.

Although the foregoing description is based on the use of five dice with six surfaces each, other numbers of dice are equally possible. Also, it is possible to provide cubic dice with only three different indicia thereon, i.e. with two surfaces each carrying the same indicia.

If the game is played with cards, the deck will usually consist of 30 cards with 5 aces and five each of two's through six's. The first round of the game will be played with the deck of cards and, after the step-up wagers have been placed, the second round is played with dice. Alternatively, both levels may be played with cards, either with one pack of, say, 30 cards for each level, or with a double pack.

I claim:

1. Method of playing a dice game, which comprises:

providing a given number of rolling dice, bet indicators and a playing surface divided in first and second sections and having first wager betting boxes and associated step-up betting boxes disposed thereon for placing the bet indicators;

placing a first wager in a betting box in the first section by at least one player;

rolling the dice;

determining a first rolled combination of indicia on the dice;

repeating the placing step if the first wager does not correspond to the first rolled combination;

placing a step-up wager in a step-up betting box associated with the first wager betting box;

placing a second wager by at least one player in a betting box in the second section in a column of betting boxes associated with the first betting box;

temporarily separating the dice corresponding to the first rolled combination from remaining dice of the given number of dice;

rolling the remaining dice;

determining a final rolled combination of indicia on the remaining dice and the dice of the first rolled combination; and paying the player predetermined winning odds if the final rolled combination corresponds to the second wager.

2. The method according to claim 1, which comprises placing a wager of a given amount in the first wager placing step and placing a second wager in the second wager placing step at least double the given amount.

3. The method according to claim 1, which comprises choosing the step-up wager in the step-up wager placing step to be at least as great as the first wager in the first wager placing step.

4. The method according to claim 1, which further comprises, subsequently to the step of determining the first rolled combination, paying the player appropriate odds if the first wager corresponds to the first rolled combination.

5. Method of playing a dice and card game, which comprises:

providing a given number of rolling dice and a given number of playing cards, bet indicators and a playing surface divided in first and second sections and having first wager betting boxes and associated step-up betting boxes disposed thereon for placing the bet indicators;

placing a first wager in a betting box in the first section by at least one player;

rolling the dice or exposing playing cards;

determining a first combination from indicia on the rolled dice or from the exposed playing cards;

repeating the placing step if the first wager does not correspond to the first combination;

placing a step-up wager in a step-up betting box associated with the first wager betting box;

placing a second wager by at least one player in a betting box in the second section in a column of betting boxes associated with the first betting box;

temporarily separating the dice or the cards of the first combination from remaining dice or cards;

rolling the remaining dice or exposing additional cards;

determining a final combination with the remaining dice or the additional cards and the first combination; and paying the player predetermined winning odds if the final combination corresponds to the second wager.

6. The method according to claim 5, which comprises placing a wager of a given amount in the first wager placing step and placing a second wager in the second wager placing step at least double the given amount.

7. The method according to claim 5, which comprises choosing the step-up wager in the step-up wager placing step to be at least as great as the first wager in the first wager placing step.

8. The method according to claim 5, which further comprises, subsequently to the step of determining the first combination, paying the player appropriate odds if the first wager corresponds to the first combination.

* * * * *